US006195803B1

(12) United States Patent
Russell et al.

(10) Patent No.: US 6,195,803 B1
(45) Date of Patent: Mar. 6, 2001

(54) SPORTS ACTIVITY GLOVE ATTACHED TO THE HAND WITH REUSABLE ADHESIVE

(76) Inventors: Marsha A Russell, 26 Elm St., Peabody, MA (US) 01960; Paul Robbat, 29 Aberdeen Rd., Chelmsford, MA (US) 01863; John J Richard, 45 Lexington Dr., Hampstead, NH (US) 03841

( * ) Notice: Subject to any disclaimer, the term of this patent is extended or adjusted under 35 U.S.C. 154(b) by 0 days.

(21) Appl. No.: 09/039,212

(22) Filed: Mar. 13, 1998

Related U.S. Application Data

(63) Continuation-in-part of application No. 08/638,567, filed on Jun. 19, 1995, now abandoned.

(51) Int. Cl.[7] ..... A41D 19/00
(52) U.S. Cl. ..... 2/161.1; 2/159; 2/164
(58) Field of Search ..... 2/159, 161.1, 161.2, 2/161.3, 164, 167

(56) References Cited

U.S. PATENT DOCUMENTS 5,020,547 * 6/1991 Strock ..... 128/891
5,164,231 * 11/1992 Davis ..... 427/256

* cited by examiner

*Primary Examiner*—Michael A. Neas
(74) *Attorney, Agent, or Firm*—Mark P. White

(57) ABSTRACT

A sports activity glove is formed from a flat sheet of material, such as leather, cloth, or synthetic material, and has a wear-resistant outer side and an inner side which contacts the palm of the wearer. The glove contains a thumb hole, and the user inserts a thumb into the thumb hole and wraps the glove about the hand, fastening it at the back of the hand by means of a hook and loop fastener. The inner side of the glove is coated with a pressure-sensitive, heat activating adhesive, which sticks to the hand and prevents the glove from slipping when in use. The adhesive is hypoallergenic to avoid irritating the hand of the wearer. The glove may be put on and taken off repeatedly without reducing the efficacy of the adhesive.

11 Claims, 7 Drawing Sheets

SPORTS ACTIVITY GLOVE ATTACHED TO THE HAND WITH REUSABLE ADHESIVE

This application is a continuation-in-part of application No. 08/638,567 filed on 6/19/95, now abandoned.

BACKGROUND OF THE INVENTION

1. Field of the Invention

The present invention relates to gloves for use in sports activities such as golf and tennis, and more specifically to gloves which may be attached to the hand with a reusable adhesive.

2. Description Relative to the Prior Art

Many activities, especially athletic activities, are enhanced by the use of a glove or gloves to prevent blistering or other damage to the hands of the wearer. Alternately, the use of gloves may improve the wearer's grip.

As an example, many golfers, baseball players, and tennis players wear special gloves for both these purposes, and the dozens of so-called golf glove patents have issued from the USPTO in recent years. (These "golf" gloves are commonly used by tennis players and baseball players as well.) Examples of such gloves include these are U.S. Pat. No. 2,293,347 (Lindfield) and U.S. Pat. No. 5,335,916 (Nee).

One of the characteristics of this type of glove is a snug fit to the hand of the user. If the golf glove is too loose, it may abrade the hand of the wearer, defeating its essential purpose. Or the glove may bunch, causing the wearer an uncomfortable feeling, and possibly irritating the wearer's hand.

The current invention provides a unique solution to the problem of providing a snug-fitting glove which perfectly fits the hand of every wearer, and which does not slip or rotate on the hand of the wearer. This result is accomplished by literally "gluing" the glove to the wearer's hand with a special adhesive which is easily removable and which will not irritate the skin of the normal user.

SUMMARY OF THE INVENTION

A general object of the current invention is to provide an activity glove which protects the wearer's hand from blistering or abrasion during activities such as golf, baseball, and tennis.

A specific object of the current invention is to provide this glove in a form which allows a single size to be used for a wide variety of wearers. A further specific object of the current invention is to provide a glove which neither slips nor rotates on the hand of the wearer.

According to one aspect of the invention the glove is formed from a thin sheet of glove material having an outer side and an inner side containing a thumb hole. The glove has a first fastener edge and a second fastener edge, and a layer of adhesive material is bonded to the inner side of the sheet. A fastener is attached to the first and second fastener edges, so that the glove may be wrapped around the hand with the thumb extended through the thumb hole, with the inner side adjacent to the hand, The adhesive adheres to the palm of the hand, and the first and second fastener edges join at the back of the hand by means of the fastener.

According to another aspect of the invention, the adhesive is pressure-sensitive.

According to yet another aspect of the invention, the adhesive activates on or around human body temperature.

According to still another aspect of the invention, holes have been formed in the palm area of the glove material to prevent wrinkling.

According to a final aspect of the invention, fastener is a hook and loop fastener, with the hook material attached to one of the fastener edges, and the loop material attached to the other fastener edge.

BRIEF DESCRIPTION OF THE DRAWINGS

These, and further features of the invention, may be better understood with reference to the accompanying specification and drawings depicting the preferred embodiment, in which.

DETAILED DESCRIPTION OF THE PREFERRED EMBODIMENTS

Figure 1:
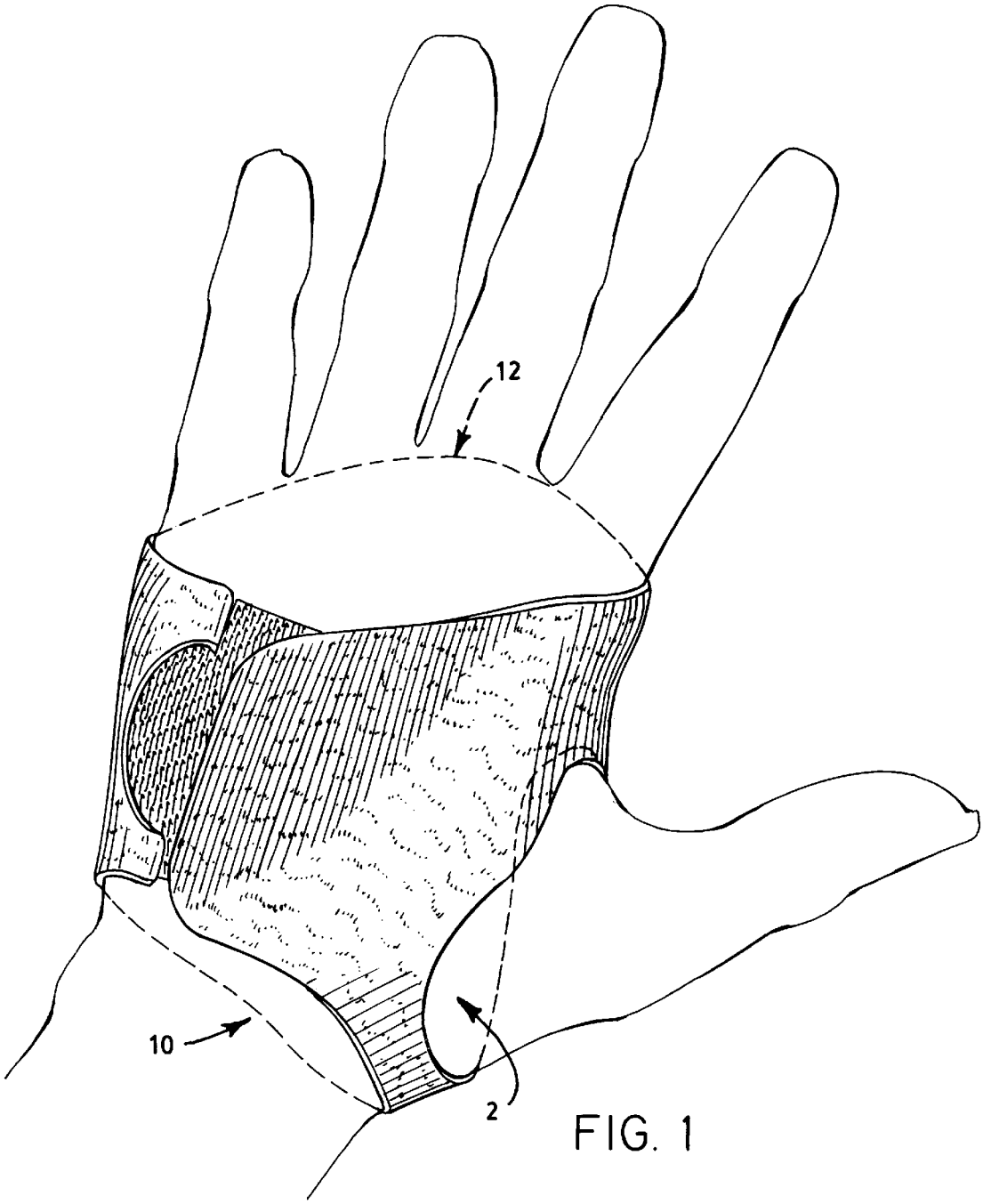
FIG. 1 depicts a perspective view of the glove, showing it attached to the hand of the wearer.

The preferred embodiments may be understood by first referring to FIG. 1, which depicts the invention in plan view as viewed from above.

As seen in FIG. 1, the glove is provided as a flat sheet of material which is then wrapped around the wearer's hand. The glove is fingerless, and is made from any number of materials, including cloth, synthetic fabric, leathers, and leather-like materials, either natural or synthetic.

Figure 2:
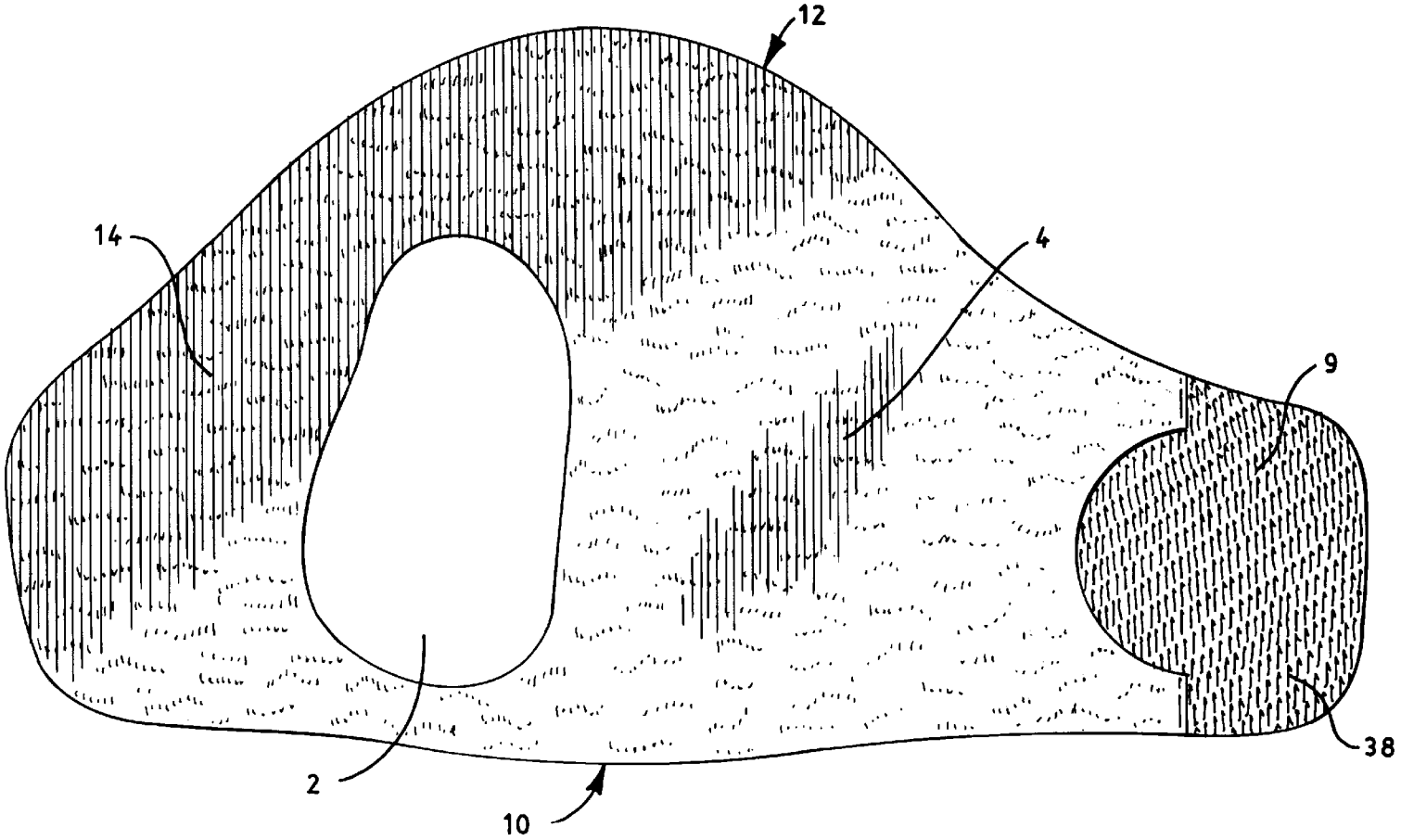
FIG. 2 depicts a top plan view of the glove.
Figure 8:
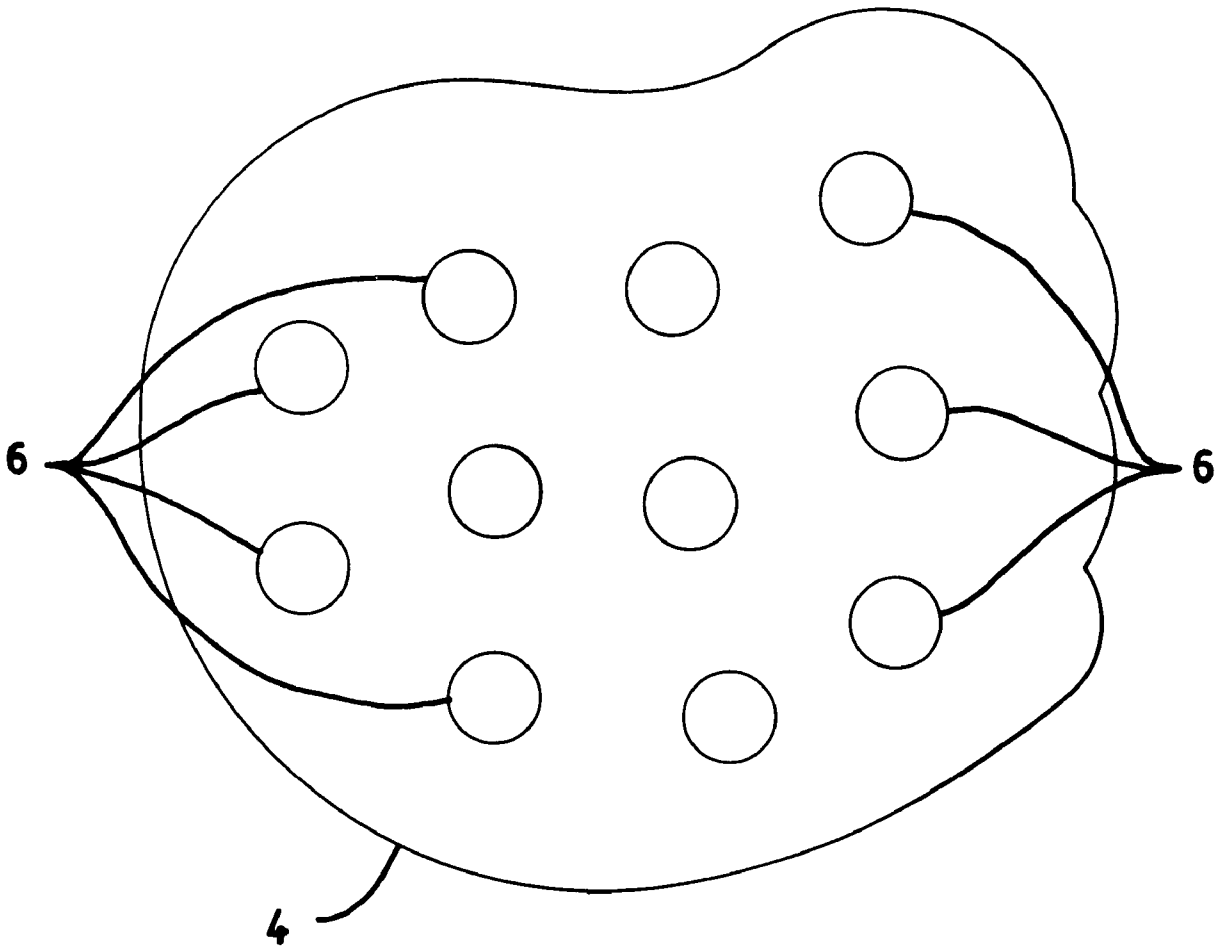
FIG. 8 depicts the palm area of the glove, showing the relief holes.

Referring to FIG. 2, the glove has a large thumb hole 2 through which the wearer's thumb is inserted. Adjacent to the thumb hole is the palm area 4, as seen in FIG. 8, in which relief holes 6 have been cut. It has been found that the inclusion of such relief holes in the palm area reduces wrinkling of the glove when attached to the user's hand.

The straight edge of the glove 10 which appears parallel to the bottom of the page in FIG. 2 is the "wrist edge" of the glove, while the rounded edge 12 at the opposite side is the "finger edge" of the glove. To put on the glove the thumb is inserted through the thumb hole, with the wrist edge toward the wrist, and the finger edge toward the fingers. FIG. 1 depicts the glove on the hand of a wearer.

Figure 3:
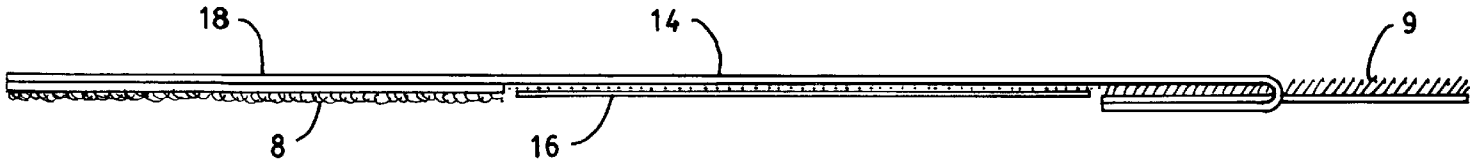
FIG. 3 depicts a side elevation view of the clove.

One of the key features of the glove which makes it unique is the use of a non-slip material, or, alternatively, of an adhesive 44 on the inner surface of the glove which sticks to the wearer's hand, preventing the glove from slipping. Referring now to FIG. 3, the sheet from which the glove is formed has an inner surface 14 , which is worn close to the hand, and an outer surface 16. The inner surface, or "hand side" of the glove, is the non-slip surface 18, which may, in some embodiments, be coated with an adhesive.

In the preferred embodiment the adhesive is both pressure sensitive, and heat activated, so that the heat of the wearer's hand, together with a slight pressure against the palm when putting the glove on, will cause the glove to adhere to the wearer's hand. In the preferred embodiment the glove is easily removed without destroying the efficacy of the adhesive, and without irritating the hand of the wearer.

It has been found an adhesives coating with the qualities described above can be made by first applying a sealant layer to the hand side of the glove. The sealant used in the preferred embodiment is a natural rubber, which is extruded onto the glove with a thickness of between 0.5 mils and 5 mils.

Figure 6:
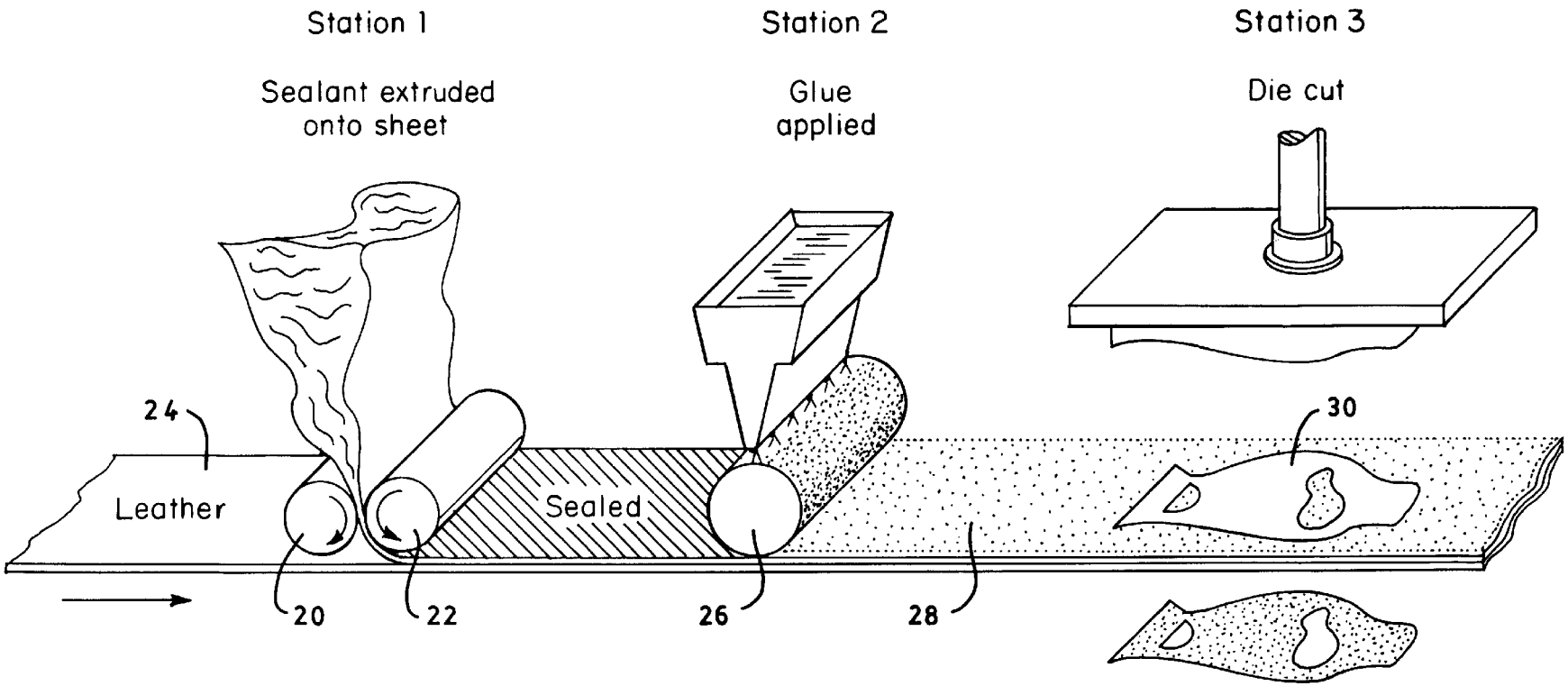
FIG. 6 depicts the extrusion process by which the adhesive is attached to the glove.
Figure 7:
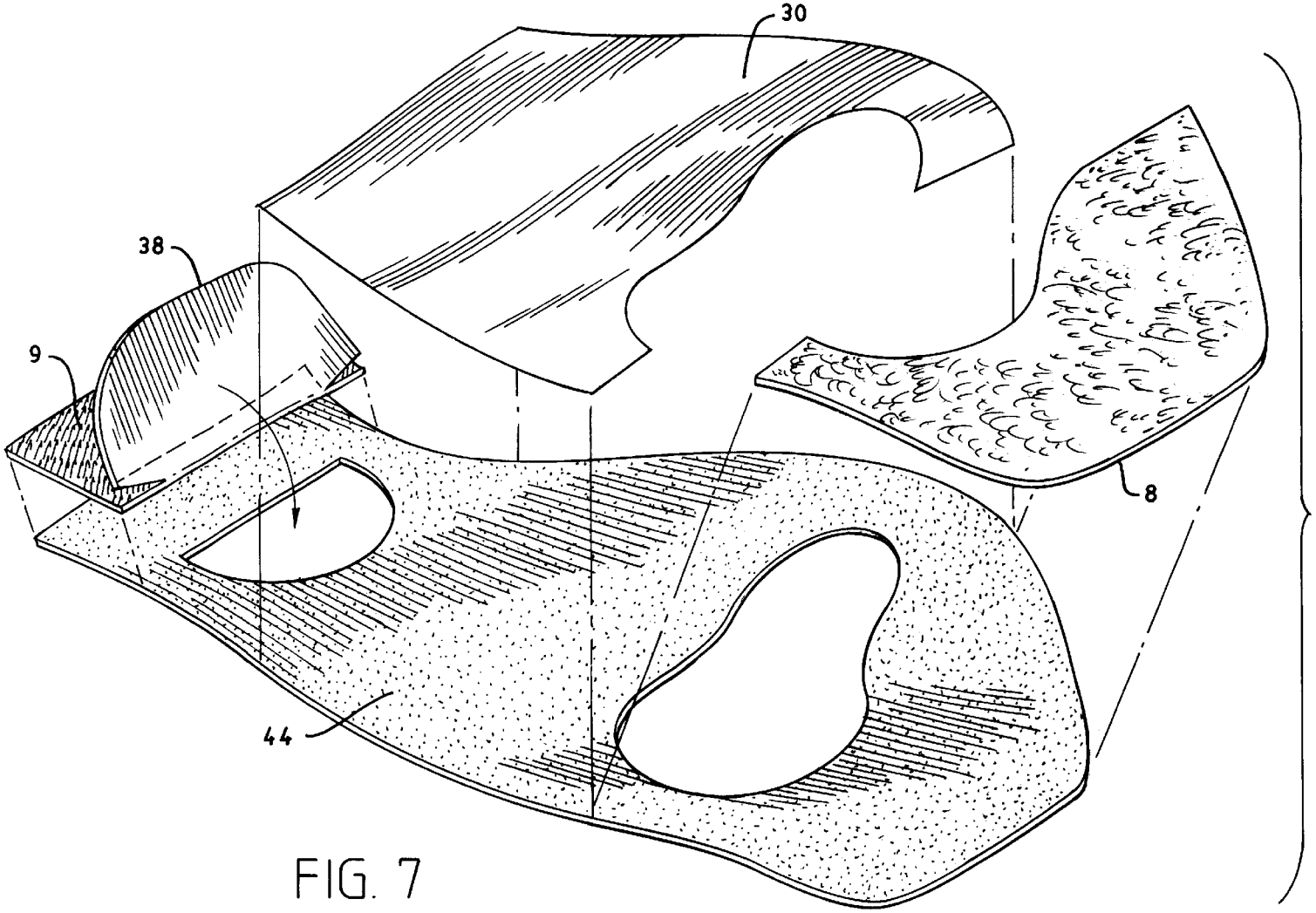
FIG. 7 depicts an exploded perspective view of the glove, with the layers of material separated to illustrate the method of assembly of said layers.

The application of the sealant may be understood by referring now to FIG. 6, which shows the application process, known as extrusion, in cross section. The rubber, heated to the point of liquefaction, is applied between the two rollers 20 and 22. The rubber is squeezed between the two rollers, resulting in a uniform thickness which is rolled, under pressure, onto the sheet material 24 from which the glove is made. The sheet is carried on a conveyer belt whose motion is synchronized with that of the roller motion so that the material is smoothly applied.

Following the application of the sealer, the coated glove sheet is allowed to cool for at least several minutes, and the contact adhesive is applied in an extrusion process similar to that just described for the sealant to an identical thickness to that of the sealant. The adhesive, or "glue", is applied via roller 26 which is then extruded onto the sealant layer. Finally, a paper with a non-stick surface is dye-cut onto the glove material to prepare the glove for shipping. (The paper is normally removed before the glove is worn.) Finally the glove shape is dye-cut from the glove material.

It has further been found that the sealant and adhesive may be mixed and applied in a single extrusion process, producing approximately the same result as the two-stage process described above.

It has been found that a commercially available contact adhesive, H586®, manufactured by Flexcon, Inc., of Peabody, Massachusetts, when combined with a sealant in the process described above, produces a contact adhesive which is activated by body heat, and which has the properties required for this invention.

It has been further noted that the adhesive made in this way can be repeatedly applied and removed from the hand without losing its efficacy. In fact, this adhesive retains its adhesive qualities even after having been subjected to dust and other foreign material, which has been subsequently removed from its surface.

Figure 4:
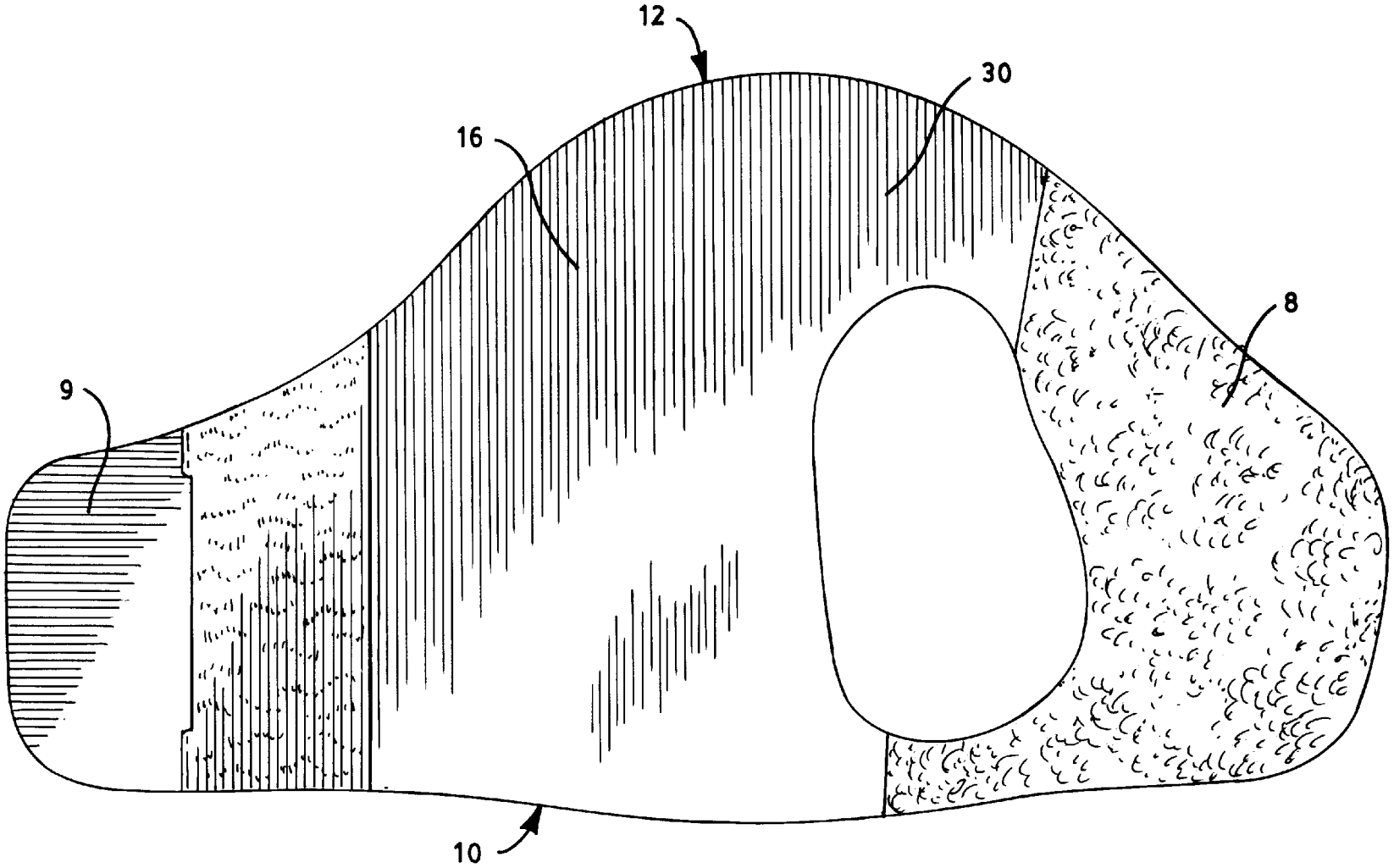
FIG. 4 depicts a bottom plan view of the glove.
Figure 5:
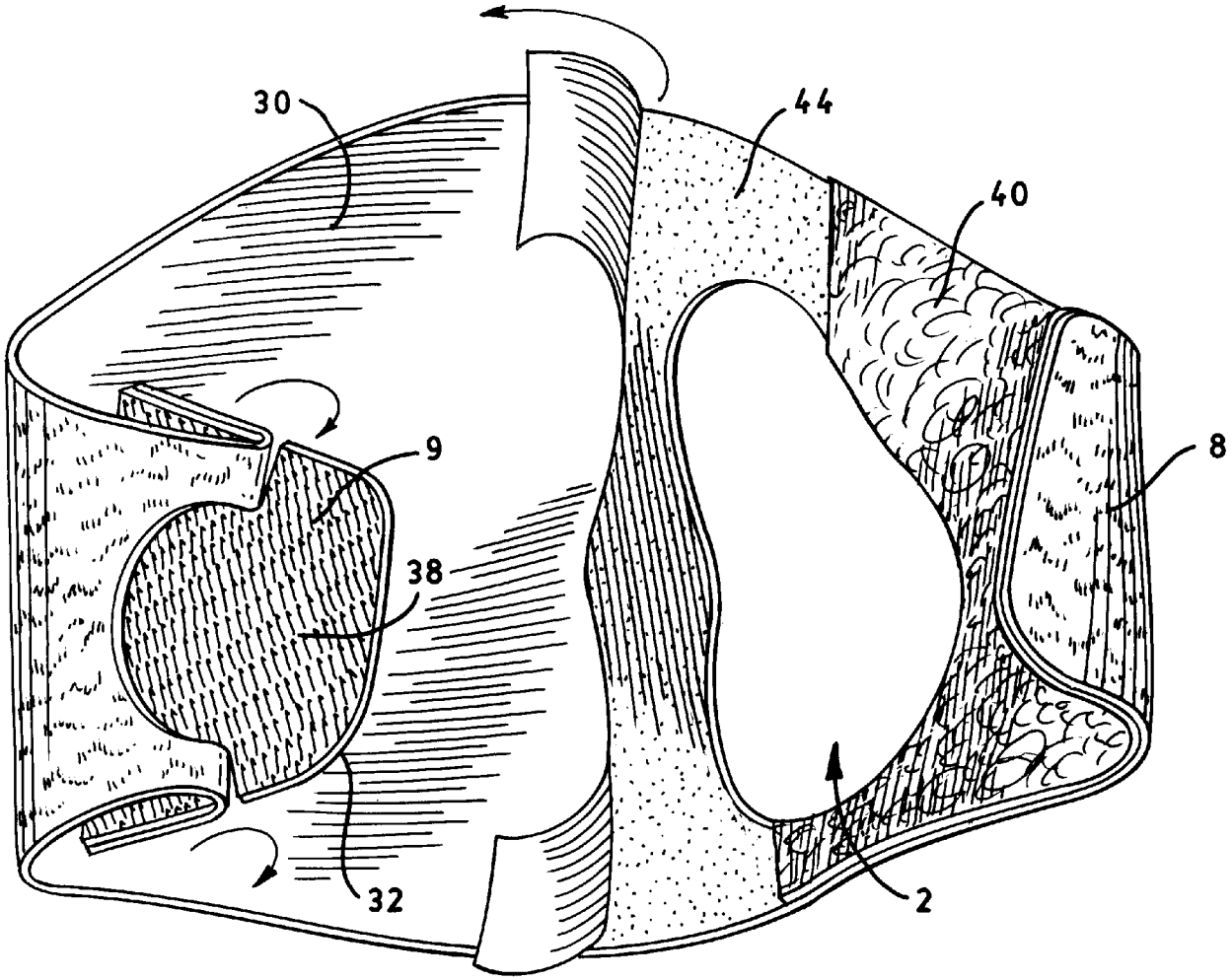
FIG. 5 depicts a perspective view of the glove, with the inside face displayed, prepared to receive the hand of the user.

The glove as seen in FIGS. 2 and 4, has two opposing fastener edges 8 and 9. When the glove is wrapped around the hand, as depicted in FIG. 1, the two fastener edges meet at the back of the hand, and are fastened together by means of a hook and loop fastener such as the Velcro ® fastener made by Velcro International, Inc. of New York, New York. Both the hook 38, attached to edge 9, and loop material 40, attached to edge 8, are attached to the inner side of the glove by means of the adhesive, but the hook material is attached to a tab 32, as seen in FIG. 5, which is doubled back to expose the hook material in the same plane as the outer side of the glove. Thus, when the two fastener edges meet at the back of the hand, the hook and loop materials face each other, and engage, securing the glove about the back of the hand.

In other embodiments, other types of fasteners may be used, including belts with buckles, laces, etc.

While the invention has been described with reference to specific embodiments, it will be apparent that improvements and modifications may be made within the purview of the invention without departing from the scope of the invention defined in the appended claims.

What is claimed is:

1. A sports activity glove comprising:

a sheet of glove material having an outer side and an inner side, containing a thumb hole, and having a first fastener edge and a second fastener edge, and comprising:

a layer of adhesive, bonded to the inner side of the sheet; and a fastener attached to the first and second fastener edges;

so that the glove may be wrapped around the hand with the thumb extended through the thumb hole, with the inner side adjacent to the hand, the first and second fastener edges in proximity at the back of the hand and joined by the fastener.

2. The glove of claim 1, wherein the adhesive further comprises a pressure-sensitive adhesive.

3. The glove of claim 2, wherein the pressure-sensitive adhesive further comprises a heat-activated adhesive which activates on or around human body temperature, and which can be repeatedly used without losing its efficacy.

4. The glove of claim 3, wherein the fastener further comprises a hook and loop fastener, with the hook material attached to one of the fastener edges, and the loop material attached to the other fastener edge.

5. The glove of claim 4, wherein the glove material further comprises one of the following group:

leather;

imitation leather;

cloth;

synthetic fabric; and rubber.

6. The glove of claim 3, wherein the glove further comprises a palm area, and where relief holes have been cut through the palm area to reduce wrinkling.

7. The glove of claim 3, wherein the pressure-sensitive adhesive further comprises:

a layer of sealant, further comprising natural rubber or acrylic, applied to the inner surface by extrusion, having a thickness of between 0.5 mils and 5 mils; and a layer of contact adhesive, applied after the sealant layer and on top of the sealant layer by extrusion, having a thickness of between 0.5 mils and 5 mils.

8. The glove of claim 4, wherein the glove further comprises a palm area, and where relief holes have been cut through the palm area to reduce wrinkling.

9. The glove of claim 4, wherein the pressure-sensitive adhesive further comprises:

a layer of sealant, further comprising natural rubber or acrylic, applied to the inner surface by extrusion, having a thickness of between 0.5 mils and 5 mils; and a layer of contact adhesive applied after the sealant layer and on top of the sealant layer by extrusion, having a thickness of between 0.5 mils and 5 mils.

10. The glove of claim 5, wherein the glove further comprises a palm area, and where relief holes have been cut through the palm area to reduce wrinkling.

11. The glove of claim 5, wherein the pressure-sensitive adhesive further comprises:

a layer of sealant, further comprising natural rubber or acrylic, applied to the inner surface by extrusion, having a thickness of between 0.5 mils and 5 mils; and a layer of contact adhesive, applied after the sealant layer and on top of the sealant layer by extrusion, having a thickness of between 0.5 mils and 5 mils.

* * * * *